US009826838B2

(12) United States Patent
Piretti

(10) Patent No.: US 9,826,838 B2
(45) Date of Patent: Nov. 28, 2017

(54) CHAIR WITH ELASTICALLY-DEFORMABLE SEAT AND/OR BACKREST

(71) Applicant: PRO-CORD S.p.A., Bologna (IT)

(72) Inventor: Giancarlo Piretti, Bologna (IT)

(73) Assignee: PRO-CORD S.P.A., Bologna (IT)

( * ) Notice: Subject to any disclaimer, the term of this patent is extended or adjusted under 35 U.S.C. 154(b) by 0 days.

(21) Appl. No.: 15/157,483

(22) Filed: May 18, 2016

(65) Prior Publication Data

US 2016/0255960 A1 Sep. 8, 2016

Related U.S. Application Data

(63) Continuation-in-part of application No. 14/958,815, filed on Dec. 3, 2015, now abandoned.

(30) Foreign Application Priority Data

Dec. 4, 2014 (IT) ..... TO2014A1007

(51) Int. Cl.
*A47C 5/04* (2006.01)
*A47C 7/44* (2006.01)
(Continued)

(52) U.S. Cl.
CPC ..... *A47C 7/44* (2013.01); *A47C 5/04* (2013.01); *A47C 5/06* (2013.01); *A47C 5/12* (2013.01);
(Continued)

(58) Field of Classification Search
CPC .... A47C 5/04; A47C 5/06; A47C 5/08; A47C 7/002; A47C 7/14; A47C 7/44
See application file for complete search history.

(56) References Cited

U.S. PATENT DOCUMENTS 5,123,702 A * 6/1992 Caruso ..... A47C 3/04 297/239
5,338,094 A * 8/1994 Perry ..... A47C 1/03255 297/286
(Continued)

FOREIGN PATENT DOCUMENTS

DE 1092322 B 11/1960
DE 202005017080 U1 1/2006
NL 34304 C 12/1934

OTHER PUBLICATIONS

Italian Search Report and Written Opinion dated Jun. 19, 2015 for Application No. TO2014A001007.

*Primary Examiner* — Philip F. Gabler
(74) *Attorney, Agent, or Firm* — Patterson & Sheridan, L.L.P.

(57) ABSTRACT

A chair comprising: a metal frame formed by a plurality of metal elements, including a seat portion having two seat support elements and a backrest portion having two backrest support elements extending upwardly from the seat portion, a flexible backrest panel and/or a flexible seat panel of plastic material having two lateral hollow portions into which respective support elements are inserted, wherein, in a rest condition, there is a transverse clearance between outer edges of said lateral hollow portions and the respective support elements and wherein, in a deformed condition of the flexible backrest panel and/or flexible seat panel said transverse clearance is reduced to zero.

13 Claims, 7 Drawing Sheets

(51) Int. Cl.

| | |
|---|---|
| ***A47C 5/12*** | (2006.01) |
| ***A47C 5/06*** | (2006.01) |
| ***A47C 7/00*** | (2006.01) |
| ***A47C 7/14*** | (2006.01) |
| ***A47C 7/16*** | (2006.01) |
| ***A47C 7/40*** | (2006.01) |

(52) U.S. Cl.
CPC ..... *A47C 7/002* (2013.01); *A47C 7/14* (2013.01); *A47C 7/16* (2013.01); *A47C 7/40* (2013.01)

(56) References Cited

U.S. PATENT DOCUMENTS

| | | | | | |
|---|---|---|---|---|---|
| 5,383,712 | A * | 1/1995 | Perry | A47C 1/032 | 297/239 |
| 6,003,948 | A * | 12/1999 | Holbrook | A47C 3/12 | 297/440.15 |
| 6,634,717 | B2 * | 10/2003 | Kown | A47C 3/023 | 297/160 |
| 7,871,131 | B2 * | 1/2011 | Rowland | A47C 5/06 | 297/230.11 |
| 2003/0025362 | A1 | 2/2003 | Liu | | |
| 2008/0238165 | A1 * | 10/2008 | Freestone | A47C 1/022 | 297/301.5 |
| 2013/0001994 | A1 * | 1/2013 | Wu | A47C 7/443 | 297/285 |
| 2013/0300079 | A1 * | 11/2013 | Haas | A47C 3/021 | 280/79.2 |

* cited by examiner

CHAIR WITH ELASTICALLY-DEFORMABLE SEAT AND/OR BACKREST

CROSS-REFERENCE TO RELATED APPLICATIONS

The present application is a continuation-in-part of U.S. patent application Ser. No. 14/958,815, filed on Dec. 3, 2015, which claims priority to Italian Patent Application No. TO2014A001007, filed on Dec. 4, 2014, the contents of each application are herein incorporated by reference.

BACKGROUND OF THE INVENTION

Field of the Invention

The present invention relates to a chair with elastically-deformable seat and/or backrest.

In particular, the invention relates to a chair having a metal frame formed by bent tubular elements that carry a seat panel and a backrest panel.

Description of Prior Art

As is well known in the field, to increase the comfort, the seat and/or the backrest should adapt to the weight of the user and to the backward thrust applied by the user's back.

One method for adapting the geometry of the chair to the weight of the user and to the backward thrust applied to the backrest envisages the use of "weight-activated" mechanisms with tilting and mutually-synchronized seat and backrest.

A simpler and cheaper way to adapt the geometry of the chair to the weight of the user and to the backward thrust applied on the backrest is that of providing seat and backrest made of deformable elastic elements, for example, sheets of fabric stretched on lateral supports of the seat and the backrest. These solutions are generally affected by a limited possibility of elastic deformation of the sheets forming the seat and the back.

SUMMARY OF THE INVENTION

The present invention aims to provide a chair with a simple structure, characterized by a wide adaptability of the support surfaces of the seat and/or the backrest.

According to the present invention, this object is achieved by a chair having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
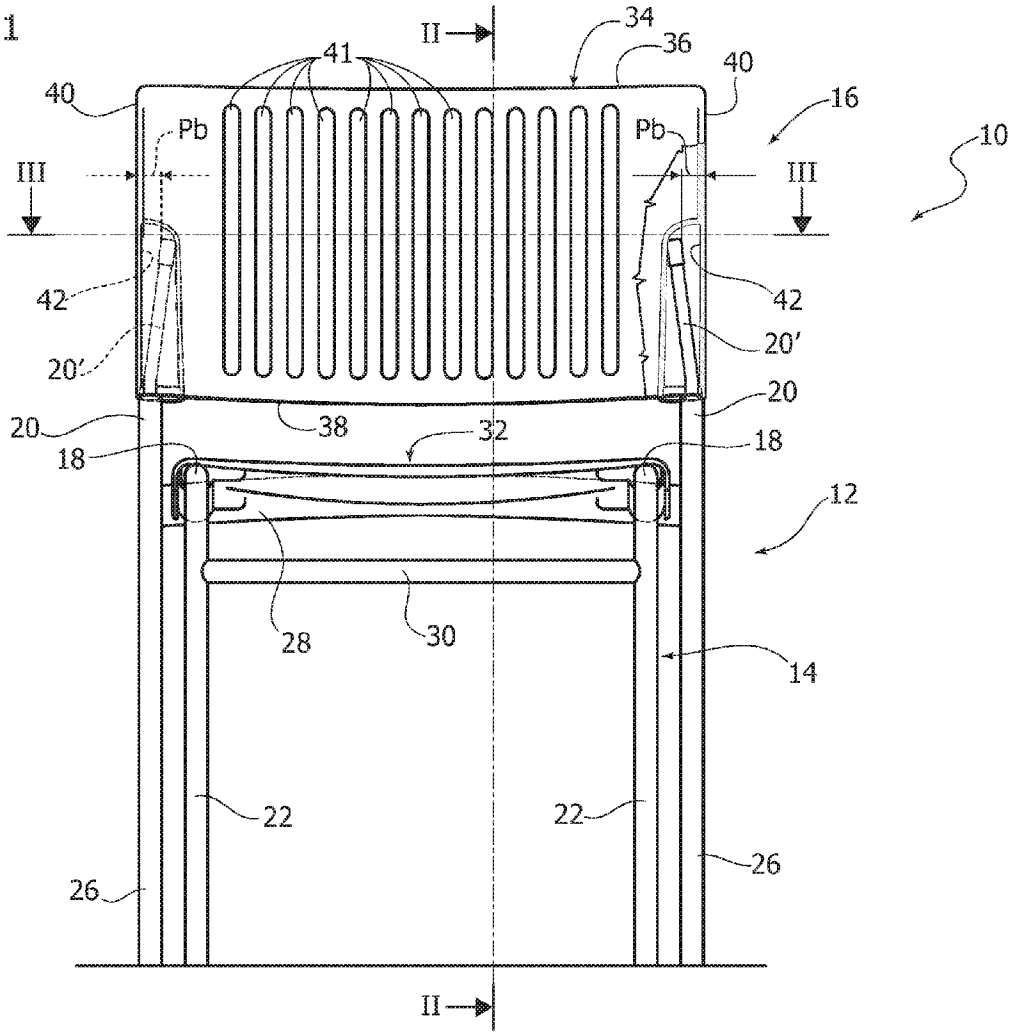
FIG. 1 is a front elevational view of an embodiment of a chair according to the present invention.
Figures 2, 5:
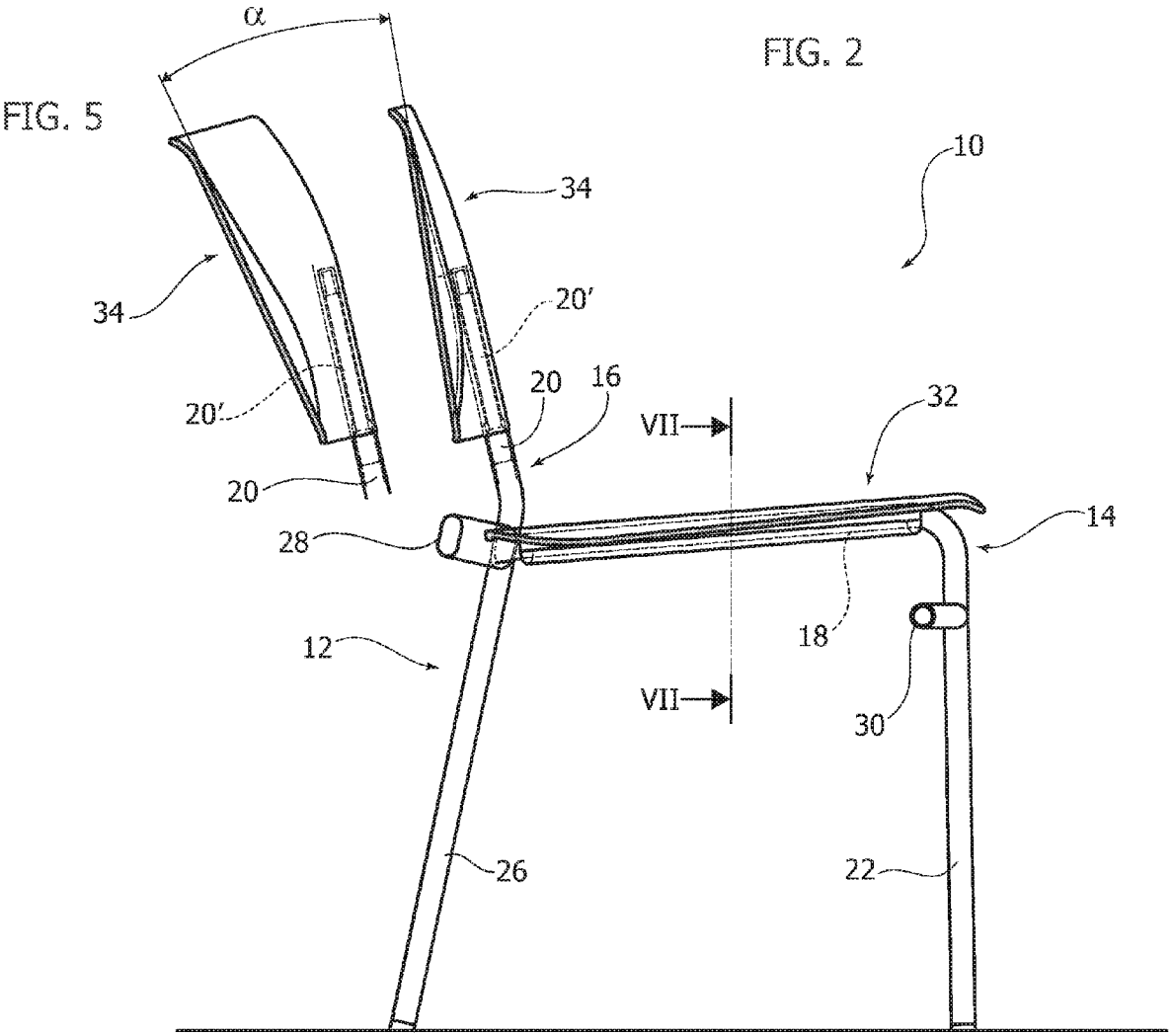
FIG. 2 is a cross-section along the line II-II of FIG. 1.
FIGS. 5 and 6 are cross-sections along the lines V-V and VI-VI of FIG. 4, illustrating the backrest in the deformed position.

With reference to FIGS. 1 and 2, numeral 10 indicates a chair according to an embodiment of the present invention. The chair 10 comprises a metal frame 12 formed of bent tubular metal elements. The frame 12 includes a seat portion 14 and a backrest portion 16. The seat portion 14 of the frame 12 comprises two seat support elements 18 oriented longitudinally and parallel to each other along opposite lateral sides of the chair 10. The backrest portion 16 of the frame 12 comprises two backrest support elements 20 parallel to each other and extending upwardly from the seat portion 14. The backrest support elements 20 are located on opposite lateral sides of the chair 10.

The frame 12 of the chair 10 comprises two front leg elements 22 connected to the front ends of the respective tubular seat support elements 18 and two rear leg elements 26. The backrest support elements 20 are formed by upward extensions of the respective rear leg elements 26. The rear end of each seat support element 18 is fixed to the lower end of the respective backrest support element 20, coinciding with the upper end of the respective rear leg element 26. The two backrest support elements 20 are fixed to respective ends of a rear cross member 28. The front leg elements 22 are fixed to respective ends of a front cross member 30.

The chair 10 comprises a flexible seat panel 32 and a flexible backrest panel 34 formed of molded plastic material with high elasticity. The flexible seat panel 32 and the flexible backrest panel 34 are capable of elastically deforming according to an arcuate shape and of returning to the initial shape when the force causing the deformation ceases. Suitable materials are, for example, nylon and polyoxymethylene (POM).

Figure 4:
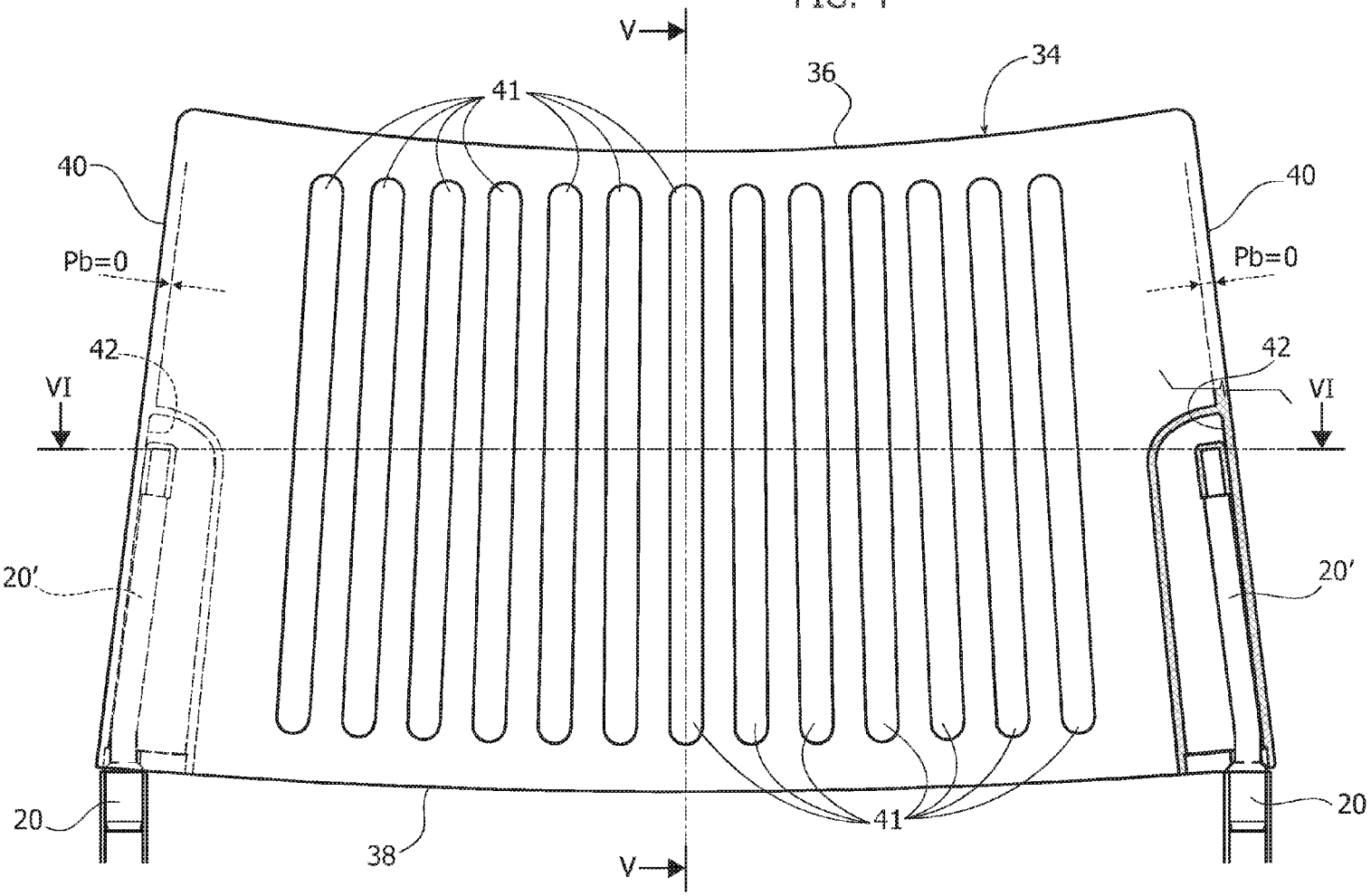
FIG. 4 is a front elevational view of the backrest of the chair of FIG. 1 in a deformed position.

With reference to FIGS. 1 and 4, the flexible backrest panel 34 has an upper side 36, a lower side 38 and two lateral sides 40. Preferably, the flexible backrest panel 34 has a central portion with a plurality of parallel vertical ridges 41. The flexible backrest panel 34 has two lateral hollow portions 42 adjacent to the respective lateral sides 40 and open on the lower side 38. The lateral hollow portions 42 are preferably formed integrally in the flexible backrest panel 34. In the shown example the lateral hollow portions 42 of the flexible backrest panel 34 have lower ends aligned with the lower side 38, upper ends located lower than the upper side 36 and outer edges aligned to the lateral sides 40 of the flexible backrest panel 34.

The backrest support elements 20 have respective terminal portions 20' inserted within respective lateral hollow portions 42 of the flexible backrest panel 34. The terminal portions 20' are inclined towards the center of the chair with respect to a vertical axis, so that the upper ends of the terminal portions 20' are shifted inwardly with respect to the respective lower end. In a rest position (FIG. 1) the terminal portions 20' are inclined with respect to the outer edges of the respective lateral hollow portions 42.

Figure 3:
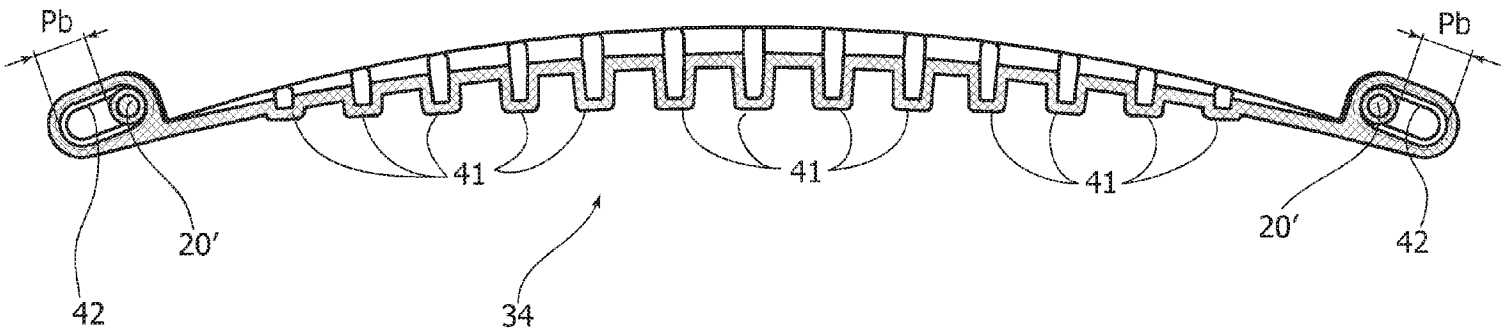
FIG. 3 is a cross-section of the backrest along the line III-III in FIG. 1.

With reference to FIGS. 1 and 3, in the rest condition, a clearance Pb in a transverse direction is provided between the external edges of the lateral hollow portions 42 of the flexible backrest panel 34 and the external sides of the respective terminal portions 20'. The transverse clearance Pb of the lateral hollow portions 42 varies along a vertical direction, from a minimum value level with the lower edge 38 of the flexible backrest panel 34, to a maximum value level with the upper edge of the lateral hollow portions 42.

Figure 6:
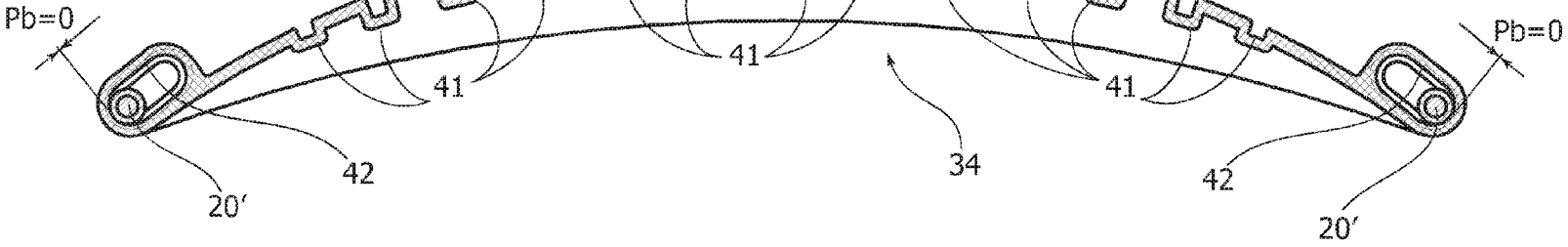

When a user leans back against the flexible backrest panel 34, the flexible backrest panel 34 is deformed elastically as shown in FIGS. 4, 5 and 6. In the deformed condition the radius of curvature of the flexible backrest panel 34 decreases with respect to the radius of curvature of the flexible backrest panel 34 in the rest condition. During the elastic deformation of the flexible backrest panel 34, the respective lateral hollow portions 42 move in a transverse direction with respect to the respective terminal portions 20', by an amount equal to the respective transverse clearance Pb.

In the deformed condition of the flexible backrest panel 34, the clearance Pb between the outer edges of the lateral hollow portions 42 and the respective terminal portions 20' is canceled, as shown in FIGS. 4 and 6. In this position the outer edges of the lateral hollow portions 42 come into contact with the respective terminal portions 20'. In the deformed position of FIG. 4 a further deformation of the flexible backrest panel 34 is prevented. The clearance Pb between the outer edges of the lateral hollow portions 38 and the respective terminal portions 20' determines the maximum deformation of the flexible backrest panel 34.

Because the clearance Pb varies in the vertical direction, the maximum deformation of the flexible backrest panel 34 is greater for areas closest to the upper side 34 and lower for areas closest to the lower side 38. Consequently, in the deformed position, the flexible backrest panel 34 inclines backwards with respect to the rest position by a preset angle $\alpha$, as shown in FIGS. 2 and 5. The backward inclination of the flexible backrest panel 34 has a similar effect to that of chairs with rigid backrests articulated about a transverse axis. The flexible backrest panel 34, because of the elasticity of the material, is subject to an elastic return force which tends to return it to the rest position. When the backward thrust applied by the back of user ceases, the flexible backrest panel 34 returns to its rest position illustrated in FIGS. 1, 2 and 3.

With reference to FIGS. 7, 8 and 9-12, the flexible seat panel 32 has a pair of lateral hollow portions 44, extending parallel to the outer edges of the flexible seat panel 32. The seat support elements 18 of the frame 12 extend through respective lateral hollow portions 44 of the flexible seat panel 32.

As shown in greater detail in FIGS. 9 to 12, in the embodiment shown in the drawings each of the lateral hollow portions 44 is defined between an outer edge of the flexible seat panel 32 and a metal support 46 fixed on the lower side of the flexible seat panel 32. In the embodiment shown in the drawings, the metal support 46 is fixed to the flexible seat panel 32 by means of screws 48 which engage respective projections which project downwardly from the lower surface of the flexible seat panel 32. Each metal support 46 extends longitudinally for the whole length of the flexible seat panel 32, adjacent to the respective outer edge thereof. Each metal support 46 has a longitudinal channel 52 with a semicircular cross-section, which contains the respective seat support elements 18.

Figure 7:
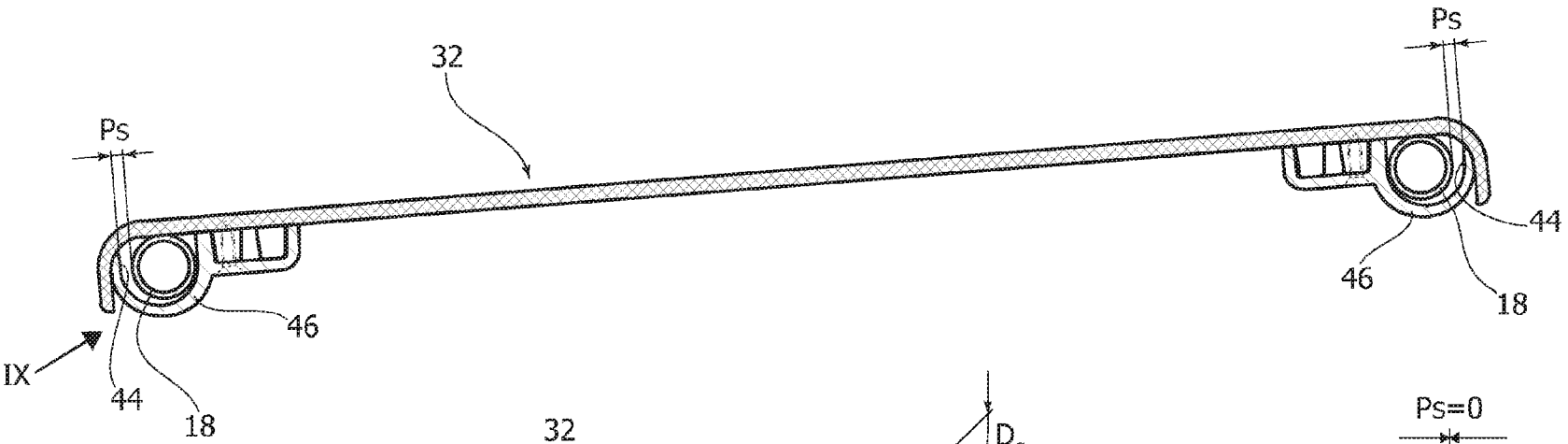
FIGS. 7 and 8 are cross-sections along the lines VII-VII of FIG. 2 showing the seat in the rest position and deformed position, respectively.
Figure 9:
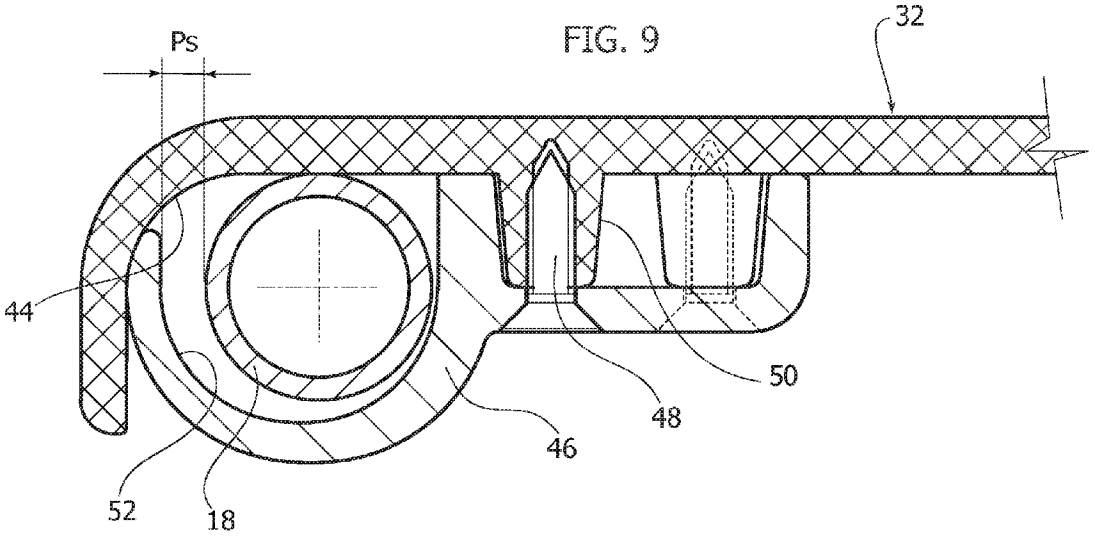
FIGS. 9 and 10 are enlarged details of the parts indicated by the arrows IX and X in FIGS. 7 and 8.

With reference to FIGS. 7 and 9, in the rest position the flexible seat panel 32 has an essentially flat shape. In each lateral hollow portions 44 of the flexible seat panel 32 there is a clearance Ps in a transverse direction between the external edge of the tubular element 18 and the corresponding external edge of the corresponding lateral hollow portion 44.

Figure 8:
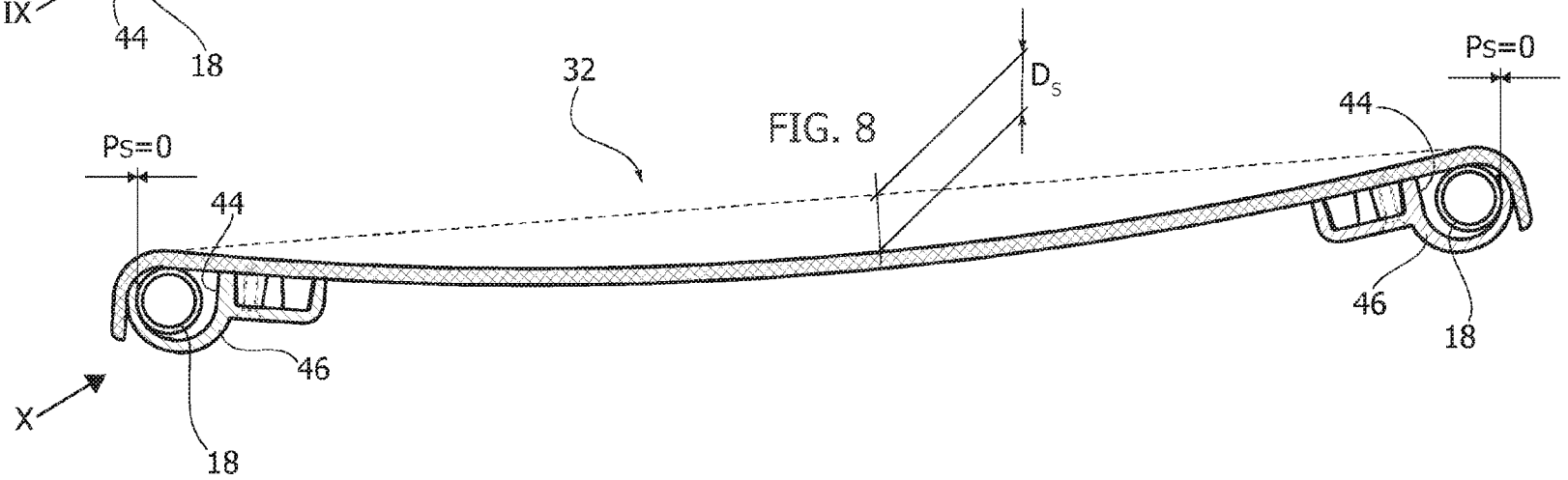

When a user is sitting on the flexible seat panel 32, the flexible seat panel 32 assumes an arcuate shape as shown in FIG. 8. The flexible seat panel 32 is elastically deformed to assume the arcuate position. During the elastic deformation of the flexible seat panel 32, the respective lateral hollow portions 44 move in a direction transverse to the respective tubular support elements 18, by an amount equal to the respective transverse clearance Ps. In the deformed position of the flexible seat panel 32, the clearance Ps between the outer edges of the lateral hollow portions 44 and the respective seat support elements 18 is canceled. When the ends of the lateral hollow portions 44 come into contact with the respective seat support elements 18, a further deformation of the flexible seat panel 32 is prevented. The clearance Ps between the outer ends of the lateral hollow portions 44 and the respective seat support elements 18 determines the maximum deformation of the flexible seat panel 32, indicated by Ds in FIG. 8.

Figure 10:
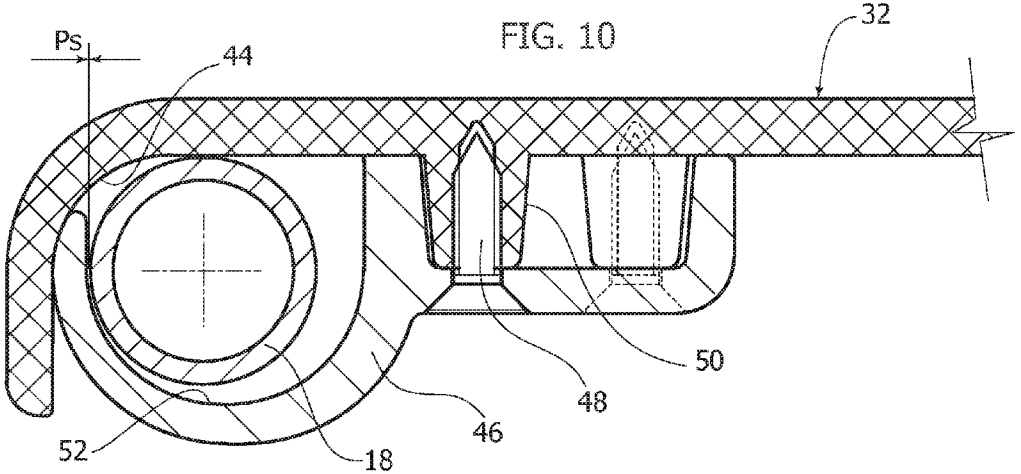

FIGS. 9 and 10 show the detail of the relative movement of the lateral hollow portions 44 with respect to the seat support elements 18, in the rest position and in the deformed position of the flexible seat panel 32.

When the user rises from the chair 10, the flexible seat panel 32 returns to the rest position as a result of its elasticity. The lateral hollow portions 44 return to the position illustrated in FIGS. 7 and 9 and the lateral clearance Ps returns to the initial value.

The clearance Ps of the lateral hollow portions 36 can be essentially constant along the longitudinal axis of the respective tubular seat support element 18. Consequently, the maximum deformation Ds of the flexible seat panel 32 is essentially constant along the central axis of the flexible seat panel 32. Alternatively, the clearance Ps between the ends of the lateral hollow portions 44 and the respective tubular elements 18 could vary along the axis of the respective seat support element 18, from a minimum value level with the front end of the flexible seat panel 32, and a maximum value level with the rear end of the flexible seat panel 32. In this way, in the conditions of use, the deformation of the seat panel has a minimum value at the front edge of the seat panel 32 and a maximum value at the rear edge of the seat panel 32. Thus, in the deformed position, the central axis of the seat panel 32 inclines backwards with respect to the rest position.

Figure 11:
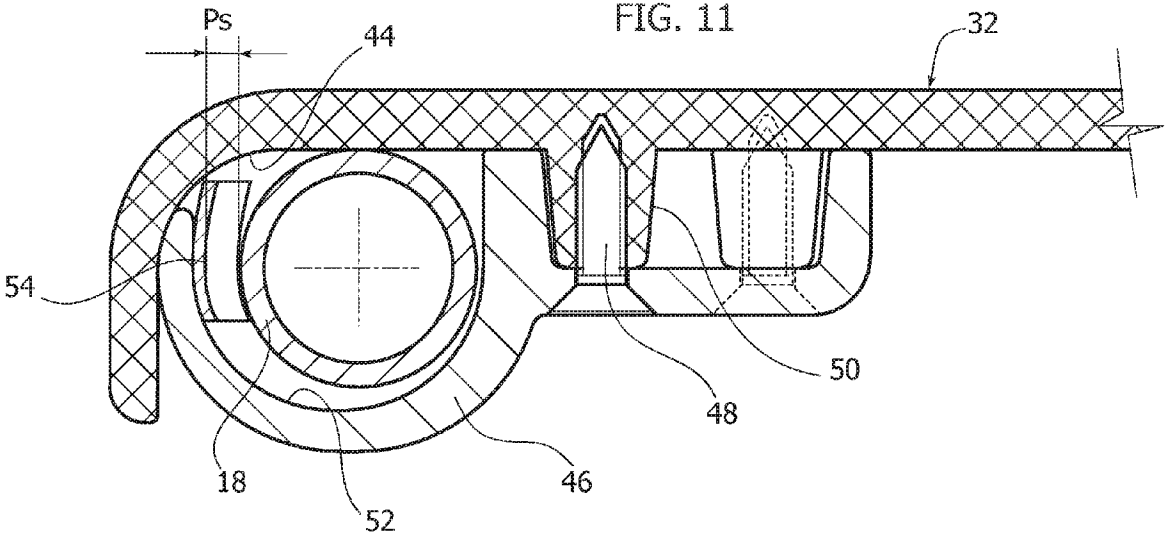
FIGS. 11 and 12 are enlarged details showing a variant of FIGS. 9 and 10.
Figure 12:
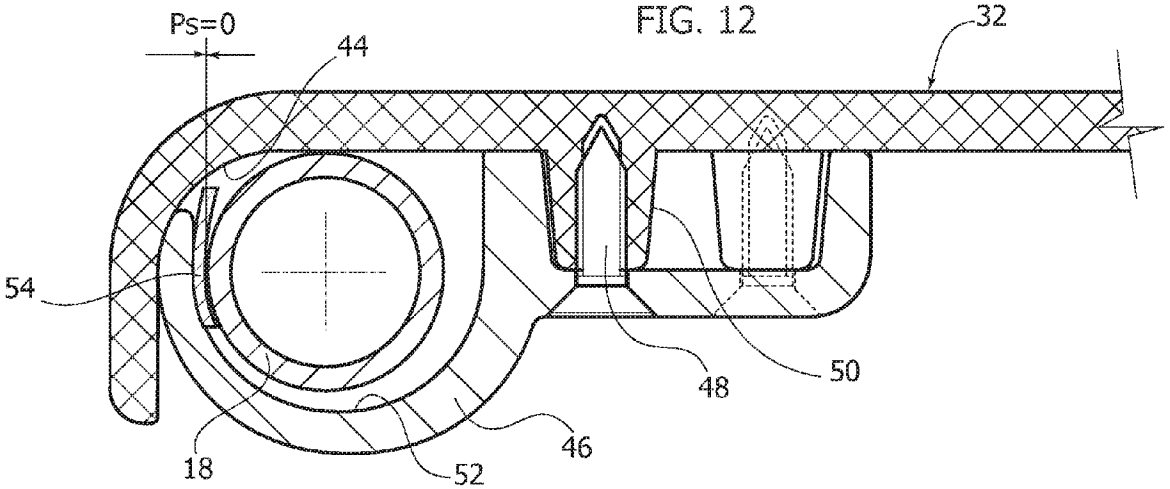

FIGS. 11 and 12 show a variant of FIGS. 9 and 10, wherein each lateral hollow portions 44 contains an undulated laminar spring 54 extending longitudinally within the respective lateral hollow portion 44, parallel to the respective tubular seat support elements 18. In the rest position of the seat shown in FIG. 11 the undulated laminar spring 54 has an undulated shape. The undulation of the spring 54 form a clearance Ps between the lateral hollow portions 44 and the respective seat support elements 18 and maintain the flexible seat panel 32 in a substantially flat position. When the user is seated on the chair the flexible seat panel 32 is deformed as shown in FIG. 8. In the seating position the spring 54 is flattened and the clearance Ps between the seat support element 18 and the outer edge of the lateral hollow portion 44 is cancelled as shown in FIG. 12. The spring 54 allows the use of materials for the flexible seat panel 32 with less elasticity since the spring 54 brings the flexible seat panel 32 back to a substantially flat position also in cases in which the elasticity of the material is low. A similar spring can also be used in the lateral hollow portions 42 of the flexible backrest panel 34.

The deformable seat and backrest of the present invention do not necessarily have to be used together. It is therefore possible to use the deformable backrest of the present invention on chairs with a different seat or the deformable seat of the present invention on chairs with a different backrest.

Of course, without prejudice to the principle of the invention, the details of construction and the embodiments can be widely varied with respect to those described and illustrated, without thereby departing from the scope of the invention as defined by the claims that follow.

The invention claimed is:

1. A chair comprising:

a metal frame formed by a plurality of metal elements, including a seat portion having two seat support elements and a backrest portion having two backrest support elements extending upwardly from the seat portion; and a flexible backrest panel or a flexible seat panel of plastic material having two lateral hollow portions into which respective support elements are inserted, wherein, in a rest condition, there is a transverse clearance between outer edges of said lateral hollow portions and the respective support elements and wherein, in a deformed condition of the flexible backrest panel or flexible seat panel said transverse clearance is reduced to zero.

2. A chair according to claim 1, wherein in the rest condition, said transverse clearance of the lateral hollow portions of the flexible backrest panel varies in the vertical direction from a minimum value at the lower ends of the lateral hollow portions to a maximum value at the upper ends of the lateral hollow portions.

3. A chair according to claim 2, wherein the tubular backrest support elements have respective terminal portions which in a rest position are inclined with respect to the outer edges of the respective lateral hollow portions and wherein in the deformed position the outer edges of the lateral hollow portions come into contact with the respective terminal portions, whereby in the deformed position the flexible backrest panel inclines backwards with respect to the rest position by a preset angle.

4. A chair according to claim 1, wherein the flexible backrest panel has an upper side, a lower side and two lateral sides and wherein said two lateral hollow portions are adjacent to the respective lateral sides and open on the lower side.

5. A chair according to claim 4, wherein the lateral hollow portions of the flexible backrest panel have lower ends aligned with the lower side, upper ends located lower than the upper side and outer edges aligned to the lateral sides of the flexible backrest panel.

6. A chair according to claim 1, wherein the flexible seat panel has a pair of lateral hollow portions, extending parallel to outer edges of the flexible seat panel, the seat support elements extending through respective lateral hollow portions of the flexible seat panel.

7. A chair according to claim 6, wherein each of the lateral hollow portions is defined between an outer edge of the flexible seat panel and a metal support fixed on the lower side of the flexible seat panel.

8. A chair according to claim 7, wherein said metal support is fixed to the flexible seat panel by means of screws which engage respective projections which project downwardly from the lower surface of the flexible seat panel.

9. A chair according to claim 8, wherein each metal support extends longitudinally for the whole length of the flexible seat panel, adjacent to the respective outer edge thereof.

10. A chair according to claim 7, wherein each metal support has a longitudinal channel with a semicircular cross-section, which contains the respective seat support elements.

11. A chair according to claim 6, wherein each of said lateral hollow portions contains an undulated laminar spring extending longitudinally within the respective lateral hollow portion, parallel to the respective seat support elements.

12. A chair according to claim 1, wherein in the rest position of the flexible seat panel said transverse clearance of the lateral hollow portions of the flexible seat panel has a constant value along a longitudinal axis of the respective tubular seat support element.

13. A chair according to claim 1, wherein said frame comprises two front legs having upper ends connected to respective front ends of the seat support elements and two rear legs forming a downward extension of the respective backrest support elements, wherein the backrest support elements are fixed to respective lateral ends of a rear cross member, and wherein said front legs are fixed to respective lateral ends of a front cross member.

* * * * *